US008129307B2

(12) United States Patent
Makihara et al.

(10) Patent No.: US 8,129,307 B2
(45) Date of Patent: Mar. 6, 2012

(54) THERMOSENSITIVE RECORDING MEDIUM

(75) Inventors: Jun Makihara, Tokyo (JP); Akihito Ogino, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 53 days.

(21) Appl. No.: 12/520,514

(22) PCT Filed: Jan. 25, 2008

(86) PCT No.: PCT/JP2008/051100

§ 371 (c)(1),
(2), (4) Date: Jun. 19, 2009

(87) PCT Pub. No.: WO2008/099658

PCT Pub. Date: Aug. 21, 2008

(65) Prior Publication Data

US 2010/0099557 A1 Apr. 22, 2010

(30) Foreign Application Priority Data

Feb. 13, 2007 (JP) ..... 2007-031503
Oct. 31, 2007 (JP) ..... 2007-282831

(51) Int. Cl.
*B41M 5/333* (2006.01)
*B41M 5/337* (2006.01)

(52) U.S. Cl. ..... 503/207; 503/225; 503/226

(58) Field of Classification Search ..... None
See application file for complete search history.

(56) References Cited

U.S. PATENT DOCUMENTS

| | | | |
|---|---|---|---|
| 6,680,281 | B2 | 1/2004 | Tajiri et al. |
| 2008/0214786 | A1 | 9/2008 | Oyama |

FOREIGN PATENT DOCUMENTS

| | | | |
|---|---|---|---|
| JP | 53-091995 | | 8/1978 |
| JP | 54-128349 | A | 10/1979 |
| JP | 60-179190 | | 9/1985 |
| JP | 60-179250 | A | 9/1985 |
| JP | 61 181680 | | 8/1986 |
| JP | 61 291179 | | 12/1986 |
| JP | 05-139033 | A | 6/1993 |
| JP | 7149713 | | 6/1995 |
| JP | 08-059603 | | 3/1996 |
| JP | 10258577 | | 9/1998 |
| JP | 2000143611 | | 5/2000 |
| JP | 2001-323095 | A | 11/2001 |
| JP | 2001-347757 | A | 12/2001 |
| JP | 2003-154760 | A | 5/2003 |
| JP | 3439560 | B | 8/2003 |
| JP | 2003-301873 | | 10/2003 |
| JP | 3790648 | | 6/2006 |
| JP | 2006-264255 | A | 10/2006 |
| WO | WO93/06074 | | 4/1993 |
| WO | WO95/33714 | | 12/1995 |
| WO | WO97/16420 | | 5/1997 |
| WO | WO00/14058 | | 3/2000 |
| WO | WO02/081229 | | 10/2002 |
| WO | WO02/098674 | | 12/2002 |
| WO | WO03/029017 | | 4/2003 |
| WO | WO2004/002748 | | 1/2004 |

OTHER PUBLICATIONS

Translation, "Explanation for filing a request for early examination", filed in the corresponding JP application (2007-282831) on Feb. 10, 2009.
Translation, "Test Report", filed in the corresponding JP application (2007-282831) on Feb. 10, 2009.
Translation, "Opinion", filed in the corresponding JP application (2007-282831) on Mar. 24, 2009 in response to an office action of Mar. 9, 2009.
Notification Concerning Transmittal of International Preliminary Report on Patentability (Chapter I of the Patent Cooperation Treaty) corresponding to International Application No. PCT/JP2008/051100 dated Aug. 19, 2009.
Notification of Transmittal of Translation of the International Preliminary Report on Patentability (Chapter I or Chapter II of the Patent Cooperation Treaty) corresponding to International Application No. PCT/JP2008/051100 dated Aug. 19, 2009.
Japanese Industrial Standard (JIS) K 5101-12-1. Test methods for pigments—Part 12: Apparent density or apparent specific volume—Section 1: Loose packing method. Japanese Standards Association (2004).
Japanese Industrial Standard (JIS) K 5101-12-2. Test methods for pigments—Part 12: Apparent density or apparent specific volume—Section 2: Mechanically tamped packing method. Japanese Standards Association (2004).
Japanese Industrial Standard (JIS) K 5101-13-1. Test methods for pigments—Part 13: Oil absorption—Section 1: Refined linseed oil method. Japanese Standards Association (2004).
Japanese Industrial Standard (JIS) K 5101-13-2. Test methods for pigments—Part 13: Oil absorption—Section 2: Boiled linseed oil method. Japanese Standards Association (2004).
Japanese Industrial Standard (JIS) L 1907. Testing methods for water absorbency of textiles. Japanese Standards Association (2010).
Japanese Industrial Standard (JIS) P 8148. Paper, board and pulps—Measurement of diffuse blue reflectance factor (ISO brightness). Japanese Standards Association (2001).
Supplementary European Search Report corresponding to European Patent Application No. 08703912.9-1251/2112001 dated Jan. 22, 2010.

*Primary Examiner* — Bruce H Hess
(74) *Attorney, Agent, or Firm* — Jenkins, Wilson, Taylor & Hunt, P.A.

(57) ABSTRACT

The present invention provides a thermosensitive recording medium, which is excellent in stamping ability, anti-scratching ability, and water and plasticizer resistance of image area as well as in recording sensitivity, image quality and storage stability. The present invention is a thermosensitive recording medium having a thermosensitive recording layer containing at least a colorless or pale colored basic leuco dye and an electron accepting developing agent as a coating layer on a substrate, wherein at least an outermost layer among the thermosensitive recording layer and other optionally prepared coated layers contains powdered cellulose, wherein the powdered cellulose is prepared by a dry grinding process at ambient temperature. The thermosensitive recording medium preferably contains a condensate composition comprising 2,2'-methylenebis(4-t-butylphenol) as an electron accepting developing agent, and a cross-linked diphenylsulfone compound such as 2,2'-bis[4-(4-hydroxyphenylsulfone) phenoxy]diphenylether as a stabilizer.

3 Claims, No Drawings

THERMOSENSITIVE RECORDING MEDIUM

FIELD OF THE INVENTION

The present invention relates to a thermosensitive recording medium for recording image by utilizing a color formation reaction between a basic leuco dye and an electron accepting color developing agent.

BACKGROUND OF THE INVENTION

A thermosensitive recording medium is produced by the following way. A colorless or pale colored basic leuco dye (hereinafter referred to as "dye") and an electron accepting color developing agent (hereinafter referred to as "developing agent") such as phenolic compound are grinded and dispersed separately to form these fine particles dispersions, then these dispersions are mixed together, and a binder, a filler, a sensitizer, a slipping agent and other additives are added to produce a coating solution. Then a substrate, such as paper, synthetic paper, film or plastic, is coated with the coating solution to produce a thermosensitive recording medium. When the thermosensitive recording medium is heated by a thermal head, a hot stamp, a thermal pen or laser light and others, a recording image can be obtained by color formation owing to instant chemical reaction caused by heating. The thermosensitive recording medium is widely used not only for a terminal printer of facsimile or computer, an automatic ticket vending with the diversification of users, or a recorder for measuring instruments, but also for various tickets, receipts, labels, auto teller machines of banks, bills for gas and electricity, cash vouchers such as motorcycle-race and betting tickets and others.

However, since dyes and developing agents contained in a thermosensitive recording layer can be easily dissolved in various solvents, the thermosensitive recording medium has problems concerning storage stability such as color formation on the blanc area and reduction in level of formed color on contacting with plasticizer contained in ink (aqueous or oily) or adhesives. Furthermore, stamping ability as well as storage stability is required for business forms for delivery, bills, receipts and the like.

As a means to improve storage stability of image area, it is well know to form a protecting layer on a thermosensitive recording layer. Other means to improve storage stability of image area include using a specific developing agent and a specific stabilizer (References 1 and 2) and using the combination of a specific sensitizer with a specific stabilizer (Reference 3).

In contrast, powdered cellulose used in the present invention is prepared by hydrolyzing cellulose fiber such as pulp, followed by dry grinding to fine particles at ambient temperature, and is used to purification of foods etc. (Reference 4) because of its absorbing ability of organic solvents and the like.

Reference 1: Japanese Patent Application Public Disclosure No. 2003-154760

Reference 2: Japanese Patent Application Public Disclosure No. 2001-347757

Reference 3: International Publication WO2004/002748

Reference 4: Japanese Patent No. 3790648

Problems to be Solved by the Invention

The object of the present invention is to provide a thermosensitive recording medium, which is excellent in stamping ability, anti-scratching ability, water and plasticizer resistance of image area as well as in recording sensitivity, image quality and storage stability.

Means to Solve the Problems

The above object has been resolved by using powdered cellulose, which is prepared by dry grinding wooden or non-wooden pulp at ambient temperature and has mean particle diameter ranging from 5 to 30 μm, in at least the outermost layer among various coating layers constituting a thermosensitive recording medium. The present inventors discovered that the use of the powdered cellulose thus produced, particularly in case of selectively using condensate composition comprising condensates represented by a general formula (chemical formula 1) described below as a developing agent and a cross-linked diphenylsulfone compound represented by a general formula (chemical formula 2) described below as a stabilizer, improved the performance significantly compared to the use of other powdered cellulose and accomplished the present invention.

In other words, the present invention is a thermosensitive recording medium having a thermosensitive recording layer comprising at least a colorless or pale colored basic leuco dye and an electron accepting developing agent as a coating layer on a substrate, wherein at least an outermost layer among the thermosensitive recording layer and other optionally prepared coated layers contains powdered cellulose, wherein the powdered cellulose is prepared by dry grinding wooden or non-wooden pulp at ambient temperature and has a mean particle diameter ranging from 5 to 30 μm.

Advantages of the Invention

The present invention provides a thermosensitive recording medium, which has an excellent color formation sensitivity and is superior in stamping ability, anti-scratching ability, water and plasticizer resistance of image area.

DETAILED DESCRIPTION OF THE INVENTION

Embodiments of the present invention are explained below:

The thermosensitive recording medium is usually constructed by laminating, from underneath, an undercoating layer, a thermosensitive recording layer and a protecting layer as coating layers on a substrate. The coating layers except the thermosensitive recording layer among the above layers could be omitted and an intermediate layer could be prepared between the thermosensitive recording layer and the protecting layer. Lamination of protecting layer on the thermosensitive recording medium is preferable from a standpoint of storage stability of image area and blanc area.

In thermosensitive recording medium of the present invention, at least the outermost layer among various coating layers, particularly the protecting layer, contains powdered cellulose, wherein the powdered cellulose is prepared by dry grinding wooden or non-wooden pulp at ambient temperature and has a mean particle diameter ranging from 5 to 30 μm. Furthermore, other coating layer(s) may contain the powdered cellulose in addition to the outermost layer. Such thermosensitive recording medium may include, for example, 1) a thermosensitive recording medium having a thermosensitive recording layer containing powdered cellulose without a protecting layer, 2) a thermosensitive recording medium having, in order, a thermosensitive recording layer and a protecting layer containing powdered cellulose, 3) a thermosensitive recording medium having, in order, a thermosensitive recording layer, a coating layer containing powdered cellulose, and a protecting layer, and 4) a thermosensitive recording medium having, in order, a thermosensitive recording layer, a protecting layer, and a coating layer containing powdered cellulose, but not be limited by them.

Additionally, an undercoating layer may be formed between the substrate and the thermosensitive recording layer, and also all layers such as undercoating layer, thermosensitive recording layer and coating layer on thermosensitive recording layer may contain powdered cellulose.

The powdered cellulose used for the present invention is prepared by the steps of hydrolyzing wooden or non-wooden pulp with acid, and filtering, washing with water, dewatering, drying, grinding and sieving. This process is characterized in grinding after drying (so-called dry grinding). The term "wooden pulp" refers to pulp derived from wooden fiber made from soft-wood or hard-wood, and "non-wooden pulp" refers to pulp derived from fiber such as Brousonetia, Edgeworthia, Diplomorpha, flax, Cannabis, Hibiscus cannabinus, Manila hemp, Abacan, sisal fiber, straw (rice, oats), Saccharum bagasse, bamboo, esparto, cotton, linter and the like except wooden fiber. The term "dry grinding" in the present invention refers to the process, wherein dried pulps are treated under high pressure, then the pulps are collided each other in the air by using jet mill at ambient temperature without heating or cooling, in which the pulps are ground by the frictional force generated during the collision. Such grinding by the jet mill accompanies almost no temperature raise. The frictional force is weaker than the impact force generated during crash between pulps and beads, in a general treatment of pulps with beads in water (i.e. wet grinding). Therefore, it is considered that the internal space derived from vessel of the pulp remains and the surface of powdered cellulose prepared by dry grinding is fibrillated.

Therefore, the powdered cellulose can absorb and fixate ink in the internal space of powdered cellulose like inorganic pigments, and can absorb ink by capillary phenomena between cellulose fibers constituting powdered cellulose. It is considered that the thermosensitive recording medium containing the powdered cellulose in the outermost layer, particularly in a protecting layer, has rapid ink absorptive capacity and expresses excellent stamping ability.

Furthermore, the powdered cellulose has fine fiber exteriorly extended from the central fiber of cellulose and fibrillated surface of the fine fiber due to the property generated during the preparation. The layer containing powdered cellulose has enough strength of coating layer owing to interwound fiber, and also has excellent anti-scratching ability owing to lowered friction resistance.

Therefore, an outermost layer, particularly a protecting layer, of coating layers of the thermosensitive recording medium containing the powdered cellulose expresses superior stamping and anti-scratching ability as compared with those containing other types of powdered cellulose. For example, when cellulose is ground after the cellulose is freeze dried (e.g. Japanese Patent Application Public Disclosure No. 54-128349 etc.), the cellulose is ground by a mechanical grinder mill with the cellulose being in a state of minimum elasticity, wherein the cellulose becomes fine, which is not the shapes obtainable by dry grinding at ambient temperature as described above. Therefore, the properties of the cellulose prepared is inferior in absorbency of organic solvent, and stamping property and anti-scratching ability. Moreover, multi-porous cellulose produced by forming viscose etc. with carbon dioxide gas (e.g. Japanese Patent Application Public Disclosure No. 5-139033 and No. 2001-323095 etc.) has a form structure including air bubble, is not the shapes obtainable by dry grinding at ambient temperature as described above, and provides thermosensitive recording medium with inferior stamping and anti-scratching ability.

Since the powdered cellulose produced by the above dry grinding has a refractive index closer to that of the binder added in the same layer as compared with other inorganic pigments such as silica or calcium carbonate, and hence internal scattering (internal haze) tends not to be generated, the thermosensitive recording medium shows an excellent recording sensitivity and image quality when the powdered cellulose is contained in the thermosensitive recording layer or in the layer coated on the thermosensitive recording layer.

Additionally, the powdered cellulose has adiathermancy (oil absorption) equal to or more than that of inorganic pigments such as silica with high lubrication and provides excellent recording sensitivity and image quality when it is contained in a thermosensitive recording layer or in an undercoating layer, since heat from thermal head is utilized efficiently.

The powdered cellulose prepared by dry grinding at ambient temperature as described above includes powdered cellulose products with brand name of NP fiber (Nippon Paper Chemicals Co., Ltd.), specifically NP fiberW-10MG2 (Nippon Paper Chemicals Co., Ltd). Moreover, powdered cellulose product with brand name of KC Flock such as KC FlockW-50, KC FlockW-100G, KC FlockW-200G, KC FlockW-300G and KC FlockW-400G (Nippon Paper Chemicals Co., Ltd.), which is produced by acid hydrolysis of wooden pulp and non-wooden pulp followed with filtration, washing with water, dewatering and drying, is used as the powdered cellulose. Still moreover, products equivalent to the powdered cellulose produced by dry grinding may be used.

The powdered cellulose usable to the present invention has the following physical properties:

Mean particle diameter is in the range between 5 μm and 30 μm, preferably between 5.5 μm and 15 μm. The mean particle diameter is measured by laser diffraction/scattering. When the size of mean particle diameter is larger, the stamping ability improves, but the developing sensitivity and the image quality in the printing by thermal printer become inferior. When the size of particle diameter is smaller, the stamping ability becomes inferior because of minimizing spaces between the fiber constituting the powdered cellulose. Furthermore, it is technically difficult to prepare powdered cellulose with mean particle diameter less than 5 μm, when dry pulp of the present invention is treated under high pressure.

Oil absorption is in the range between 100 and 300 ml/100 g. The oil absorption is measured according to JIS K-5101.

Density is in the range between 0.3 and 0.6 g/cm$^3$. The density is measured according to JIS K 5101.

Water absorption at saturation is in the range between 1.5 and 4.0 cm$^3$/g. The water absorption at saturation is measured according to JIS L-1907.

Brightness is equal to 75% or more. The brightness is measured according to JIS P8148.

The powdered cellulose of the present invention may be used solely or together with other various pigments for the coating layers on a substrate. When the powdered cellulose is used together with pigments, it is preferable to include 20 parts or more of powdered cellulose as solid part per total 100 weight parts of powdered cellulose and pigment.

In this invention, it is necessary for the layer containing powdered cellulose prepared on a substrate to contain a binder, and such binder includes a water soluble polymer such as starch, polyvinyl alcohol, methylcellulose, carboxymethyl cellulose, and the like; synthetic resin emulsion such as styrene butadiene copolymer, acrylate copolymer and the like. As for the amount of powdered cellulose (or including pigment) and binder content contained in a protecting layer, solid part of binder is approximately ranging from 30 to 300 weight parts per 100 weight parts of powdered cellulose (or including pigment), and content of powdered cellulose per 100 weight parts of total solid of protecting layer is approximately ranging from 10 to 80 weight parts, preferably from 20 to 50 weight parts, more preferably from 30 to 45 weight parts. As for their amount contained in a thermosensitive recording layer, the content of powdered cellulose is approximately ranging from 1 to 20 weight parts per 100 weight parts of total solid of thermosensitive recording layer. When it is contained in undercoating layer, the content of powdered cellulose is preferably ranging approximately from 1 to 90 weight parts per total solid of undercoating layer.

The outermost layer, particularly protecting layer of the thermosensitive recording medium of the present invention preferably contains various water soluble polymers (various polyvinyl alcohols, various starches); various water soluble polymers and various cross-linking agents, synthetic resins such as acrylate and SBR; or synthetic resin and various cross-linking agents from the view point of storage stability and water resistance of image and blanc areas, and particularly preferably contains a carboxyl modified polyvinyl alcohol, an epichlorohydrin resin, and a polyamine/amide resin from the view point of water resistance and print runnability.

The carboxyl modified polyvinyl alcohol is produced as a reaction product between polyvinyl alcohol and multi-valent carboxylic acid such as fumaric acid, phthalic anhydride, mellitic anhydride, and itaconic anhydride; or an esterified products of these reactants; or a saponified product of a copolymer between vinyl acetate and ethylated unsaturated dicarboxylic acid such as maleic acid, fumaric acid, itaconic acid, crotonic acid, acrylic acid, and metacrylic acid. Specifically, the production process includes, for example, the production process exemplified in Example 1 or 4 of Japanese Patent Application Public Disclosure No. 53-91995, publication. Moreover, the saponification value of the carboxyl modified polyvinyl alcohol is preferably ranging from 72 to 100 mol %, and the degree of polymerization is ranging from 500 to 2400, preferably from 1000 to 2000.

Specific examples of the epichlorohydrin resin include a polyamide epichlorohydrin resin, a polyamine epichlorohydrin resin and the like, and these compounds can be used solely or in combination. As the amines in backbone chain of the epichlorohydrin resin, any amine from primary amines to quaternary amines can be used without restrictions. Furthermore, the cationization level of the epichlorohydrin resin is preferably less than 5 meq/g·solid (measured at pH 7) and the molecular weight is preferably more than 500,000, since the epichlorohydrin resin has a good water resistance. Specific examples of the epichlorohydrin resin include Sumirez resin 650(30), Sumirez resin 675A, Sumirez resin 6615 (Sumitomo Chemicals), WS4002, WS4020, WS4024, WS4046, WS4010, and CP8970 (SeikoPMC).

The polyamine/amide resin includes polyamide urea resin, polyalkylene polyamine resin, polyalkylene polyamide resin, polyamine polyurea resin, modified polyamine resin, modified polyamide resin, polyalkylene polyamine urea formalin resin, and polyalkylene polyamine polyamide polyurea resin. Specific examples include Sumirez resin 302 (Sumitomo Chemicals: polyamine polyurea resin), Sumirez resin 712 (Sumitomo Chemicals: polyamine polyurea resin), Sumirez resin 703 (Sumitomo Chemicals: polyamine polyurea resin), Sumirez resin 636 (Sumitomo Chemicals: polyamine polyurea resin), Sumirhez resin SPI-100 (Sumitomo Chemicals: modified polyamine resin), Sumirez resin SPI-102A (Sumitomo Chemicals: modified polyamine resin), Sumirez resin SPI-106N (Sumitomo Chemicals: modified polyamide resin), Sumirez resin SPI-203(50)(Sumitomo Chemicals), Sumirez resin SPI-198 (Sumitomo Chemicals), PrintiveA-700 (Asahi Kasei Corporation), PrintiveA-600 (Asahi Kasei Corporation), PA6500, PA6504, PA6634, PA6638, PA6640, PA6644, PS6646, PA6654, PA6702, PA 6704 (the above, SeikoPMC: polyalkylene polyamine polyamide polyurea resin), and CP8994 (SeikoPMC: polyethylene imine resin) without any restriction, they can be used solely or in combination of two kinds or more. From the viewpoint of recording sensitivity, polyamine resin (polyalkylene polyamine resin, polyamine polyurea resin, modified polyamine resin, polyalkylene polyamine urea formalin resin, polyalkylene polyamine polyamide polyurea resin) are preferable.

The content of the epichlorohydrin resin and the modified polyamine/amide resin are preferably ranging from 1 to 100 weight parts, more preferably from 5 to 50 weight parts, respectively, based on 100 weight parts of the carboxyl modified polyvinyl alcohol. When these contents are less, the cross-linking reaction becomes incomplete and the water resistance becomes worse. On the other hand, when these contents are more, the problem associated with an increased viscosity and a gelling of coating liquid will happen, and the operating performance becomes worse.

When the protecting layer containing the carboxyl modified polyvinyl alcohol, the epichlorohydrin resin and the polyamine/amide resin, the thermosensitive recording layer contacting the protecting layer preferably contains the epichlorohydrin resin and/or the carboxyl modified polyvinyl alcohol. Subjecting the thermosensitive recording layer to contain the component contained in the protecting layer makes better adhesion between the thermosensitive recording layer and the protecting layer and increases water resistance for dipping. The thermosensitive recording layer preferably contains 0.2 to 5.0 weight portions (dry weight) of the epichlorohydrin resin. The more is the content of epichlorohydrin resin, the less is the stability of coating.

The thermosensitive recording layer of the present invention comprising dye and developing agent may further contain a sensitizer, a binder, a cross-linking agent, a stabilizer, a pigment, a lubricant and the like, in addition to the above powdered cellulose.

As a dye, all well known dye in the field of conventional pressure sensitive or thermosensitive recording paper are usable without any restriction, such as triphenyl methane, fluorane, fluorene, divinyl compounds and the like are preferable. As representative examples, colorless or pale colored basic colorless dyes are shown in the following. Also, the following basic colorless dyes can be used solely or in combination of two kinds or more.

<Triphenyl Methane Leuco Dyes>

3,3-bis(p-dimethyl aminophenyl)-6-dimethyl aminophthalide (alias name: crystal violet lactone), 3,3-bis(p-dimethyl aminophenyl)phthalide (alias name: malachite green lactone)

<Fluorane Leuco Dyes>

3-diethylamino-6-methylfluorane, 3-diethylamino-6-methyl-7-anilinofluorane, 3-diethylamino-6-methyl-7-(o,p-dimethylanilino)fluorane, 3-dibutylamino-6-methyl-fluorane, 3-dibutylamino-6-methyl-7-anilinofluorane, 3-dibutylamino-6-methyl-7-(o,p-dimethylamino)fluorane, 3-dibutylamino-7-(o-chloroanilino)fluorane, 3-dibutylamino-7-(o-fluoroanilino) fluorane, 3-n-dipentylamino-6-methyl-7-anilinofluorane, 3-(N-ethyl-N-isoamylamino)-6-methyl-7-anilinofluorane, 3-(N-ethyl-N-isoamylamino)-6-chloro-7-anilinofluorane, 3-cyclohyxylamino-6-chlorofluorane <Divinyl Leuco Dyes>

3,3-bis-[2-(p-dimethylaminophenyl)-2-(p-methoxyphenyl) ethenyl]-4,5,6,7-tetrabromophthalide, 3,3-bis-[2-(p-dimethylaminophenyl)-2-(p-methoxyphenyl)ethenyl]-4,5,6,7-tetrachlorophtalide, 3,3-bis-[1,11-bis(4-pyrrolidinophenyl) ethylene-2-yl]-4,5,6,7-tetrabromophthalide, 3,3-bis-[1-(4-methoxyphenyl)-1-(4-pyrrolidinophenyl)ethylene-2-yl]-4,5,6,7-tetrachlorophthalide <Other Dyes>

3-(4-diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindole-3-yl)-4-azaphthalide, 3-(4-cyclohexylethylamino-2-methoxyphenyl)-3-(1-ethyl-2-methylindole-3-yl)-4-azaphthalide, 3,3-bis(1-ethyl-2-methylindole-3-yl)phthalide, 3,6-bis(diethylamino) fluorane-γ-(3'-nitro) anilinolactam, 3,6-bis(diethylamino) fluorane-γ-(4'-nitro) anilinolactam, 1,1-bis-[2',2',2",2"-tetrakis-(p-dimethylaminophenyl)-ethenyl]-2,2-dinytrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane, bis-[2,2,2',2'-tetrakis-(p-dimethylaminophenyl)-ethenyl]-methylmalonic dimethylester As a developing agent, all well known developing agents in the field of pressure sensitive or thermosensitive recording paper are usable. Such developing agents include, for example, inorganic compounds such as active clay, attapulgite, colloidal silica, aluminium silicate and the like, 4,4'-isopropyliden diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, 4-hydroxybenzoic benzyl, 4,4'-dihydroxydiphenyl sulfone, 2,4'-dihydroxydiphenyl sulfone, 4-hydroxy-4'-isopropoxydiphenyl sulfone, 4-hydroxy-4'-n-propoxydiphenyl sulfone, bis(3-allyl-4-hydroxyphenyl)sulfone, 4-hydroxy-4'-methyldiphenyl sulfone, 4-hydroxyphenyl-4'-benzyloxyphenyl sulfone, 3,4-dihydroxyphenyl-4'-methylphenyl sulfone, aminobenzene sulfone amide derivatives described in Japanese Patent Application Public Disclosure No. 8-59603 publication, bis(4-hydroxy phenyl thioethoxy)methane, 1,5-di(4-hydroxy phenyl thio)-3-oxapentane, bis(p-hydroxyphenyl)butylacetate, bis(p-hydroxyphenyl)methyl acetate, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol); 2,2'-thiobis(4-tert-octylphenol); phenol compounds such as cross-linked diphenylsulfone compounds etc. described in International Publication WO97/16420 publication, phenol compounds; phenol compounds described in International Publication WO02/081229 and Japanese Patent Application Public Disclosure No. 2003-301873; phenolnovolac condensate composition described in International Publication WO02/098674 and WO03/029017; urea urethane compounds described in International Publication WO00/14058 and Japanese Patent Application Public Disclosure No. 2000-143611, thiourea compounds such as N,N'-di-m-chlorophenyl thiourea etc.; aromatic carboxylic acid such as p-chloro benzoic acid, stearyl gallate, bis[4-(n-octyloxy carbonylamino)zinc salycyclate]2 hydrate, 4-[2-(p-methoxy phenoxy) ethyloxy]salicylic acid, 4-[3-(p-tolylsulfonyl)propyloxy] salicylic acid, aromatic carboxylic acid of 5-[p-(2-p-methoxy phenoxy ethoxy)cumyl]salicylic acid and salts between these aromatic carboxylic acid and multi-valent metal salts such as zinc, magnesium, aluminium, calcium, titanium, manganese, stannum, nickel and the like; and moreover antipyrine complex of zinc thiocyanate, complex zinc salt between terephthalic aldehyde acid and other aromatic carboxylic acid, and the like are included. These developing agents may be used solely or in combination of two kinds or more. Additionally, metal chelate recording components such as higher aliphatic acid metal double salts and multi valent hydroxy aromatic compounds described in Japanese Patent Application Public Disclosure No. 10-258577 may be included. These developing agents may be used in combination of two kinds or more.

Among developing agents above, preferred is the condensate composition comprising condensates represented by chemical formula 1:

[chemical formula 1]

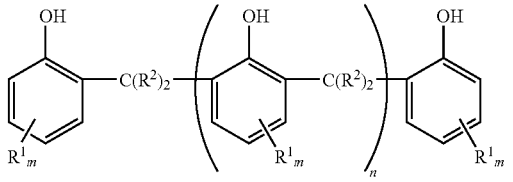

In the formula, $R^1$, may be identical to or different from the others, preferably identical, represents a hydrogen atom, a halogen atom, hydroxyl, lower alkyl, alkoxyl, cyano, nitro, aryl or aralkyl group, preferably lower alkyl, aryl or aralkyl group, most preferably lower alkyl group.

Said lower alkyl is preferably tertiary lower alkyl, and furthermore the number of carbon is preferably in the range between 1 and 5, more preferably between 1 and 4. The lower alkyl group includes methyl, ethyl, n-propyl, isopropyl, n-butyl, t-butyl, t-amyl and the like. The number of carbon of the alkoxyl group is preferably in the range between 1 and 5.

The alkoxyl group includes, for example, methoxy, ethoxy, propoxy, isopropoky, butoxy, t-butoxy and the like. The aryl group includes, for example, phenyl, tolyl, naphthyl, preferably phenyl. The aralkyl group includes α-methyl benzyl, cumyl and the like.

$R^2$, may be identical to or different from the others, preferably identical, represents a hydrogen atom, alkyl, or aryl group, and at least one of two $R^2$ binding to the same carbon is preferably a hydrogen atom, and both of the two $R^2$ are more preferably a hydrogen atom. The number of carbon of the alkyl group is preferably in the range between 1 and 5, most preferably between 1 and 4. The alkyl group includes, for example, methyl, ethyl, n-propyl, isopropyl, n-butyl, t-butyl and the like. Still furthermore, the aryl group includes, for example, phenyl, tolyl, naphthyl and the like, and preferably phenyl.

n represents an integer between 0 and 3. The condensate composition comprising condensates represented by the above general formula (chemical formula 1) includes each condensate with n=0, 1, 2 or 3, and a mixture containing at least two or more kinds among 4 kinds of the condensates.

m represents an integer between 0 and 3, preferably between 1 and 3, and more preferably 1. When m is an integer between 1 and 3, $R^1$ preferably binds to m- or p-position relative to hydroxyl of phenol group, and more preferably binds to p-position of hydroxyl of phenol group.

Among condensates represented by general formula (chemical formula 1), specific example of two nuclear condensate (i.e. condensates of two phenol back bone with n=0)

includes 2,2'-methylene bisphenol, 2,2'-methylenebis(4-chlorophenol), 2,2'-methylenebis(5-chlorophenol), 2,2'-methylene bis(4-hydroxyphenol), 2,2'-methylenebis(5-hydroxyphenol), 2,2'-methylenebis(4-methylphenol), 2,2'-methylenebis(5-methylphenol), 2,2'-methylenebis(4-ethylphenol), 2,2'-methylenebis(5-ethylphenol), 2,2'-methylenebis(4-n-propylphenol), 2,2'-methylenebis(4-isopropyl phenol), 2,2'-methylenebis(5-n-propyl phenol), 2,2'-methylenebis(5-siopropyl phenol), 2,2'-methylenebis(4-n-butylphenol), 2,2'-methylenebis(4-t-butylphenol), 2,2'-methylenebis(5-n-butylphenol), 2,2'-methylenebis(5-t-butylphenol), 2,2'-methylenebis(4-t-amylphenol), 2,2'-methylenebis(4-methoxyphenol), 2,2'-methylenebis(5-methoxyphenol), 2,2'-methylenebis(4-cyanophenol), 2,2'-methylenebis(5-cyanophenol), 2,2'-methylenebis(4-nitrophenol), 2,2'-methylenebis(5-nitorophenol), 2,2'-methylenebis(4-phenylphenol), 2,2'-methylenebis(5-phenylphenol), 2,2'-methylenebis(4-cumylphenol), 2,2'-methylenebis(5-cumylphenol), 2,2'-ethylidenebisphenol, 2,2'-ethylidenebis(4-chlorophenol), 2,2'-ethylidenebis(5-chlorophenol), 2,2'-ethylidenebis(4-hydroxyphenol), 2,2'-ethylidenebis(5-hydroxyphenol), 2,2'-ethylidenebis(4-methylphenol), 2,2'-ethylidenebis(5-methylphenol), 2,2'-ethylidenebis(4-ethylphenol), 2,2'-ethylidenebis(5-ethylphenol), 2,2'-ethylidenebis(4-n-propylphenol), 2,2'-ethylidenebis(4-isopropylphenol), 2,2'-ethylidenebis(5-isopropylphenol), 2,2'-ethylidenebis(4-n-butylphenol), 2,2'-ethylidenebis(4-t-butylphenol), 2,2'-ethylidenebis(5-n-butylphenol), 2,2'-ethylidenebis(5-t-butylphenol), 2,2'-ethylidenebis(4-t-amylphenol), 2,2'-ethylidenebis(4-methoxyphenol), 2,2'-ethylidenebis(5-methoxyphenol), 2,2'-ethylidenebis(4-cyanophenol), 2,2'-ethylidenebis(5-cyanophenol), 2,2'-ethylidenebis(4-nitrophenol), 2,2'-ethylidenebis(5-nitrophenol), 2,2'-ethylidenebis(4-phenylphenol), 2,2'-ethylidenebis(5-phenylphenol), 2,2'-ethylidenebis(4-cumylphenol), 2,2'-ethylidenebis(5-cumylphenol), 2,2'-(phenyl methylene)bisphenol, 2,2'-(phenyl methylene)bis(4-chlorophenol), 2,2'-(phenyl methylene)bis (5-chlorophenol), 2,2'-(phenyl methylene)bis (4-hydroxyphenol), 2,2'-(phenyl methyllene)bis(5-hydroxyphenol), 2,2'-(phenyl methylene)bis(4-methylphenol), 2,2'-(phenyl methylene)bis(5-methylphenol), 2,2'-(phenyl methylene)bis(4-ethylphenol), 2,2'-(phenyl methylene)bis (5-ethylphenol), 2,2'-(phenyl methylene)bis(4-propylphenol), 2,2'-(phenyl methylene)bis(4-isopropyl phenol), 2,2'-(phenyl methylene)bis(5-isopropylphenol), 2,2'-(phenylmethylene)bis(4-t-butylphenol), 2,2'-(phenyl methylene)bis(5-t-butylphenol), 2,2'-(phenyl methylene)bis (4-t-amylphenol), 2,2'-(phenyl methylene)bis(4-methoxyphenol), 2,2'-(phenyl methylene)bis(5-methoxyphenol), 2,2'-(phenyl methylene)bis(4-cyanophenol), 2,2'-(phenyl methylene)bis(5-cyanophenol), 2,2'-(phenyl methylene)bis (4-nitrophenol), 2,2'-(phenyl methylene)bis(5-nitrophenol), 2,2'-(phenyl methylene)bis(4-phenylphenol), 2,2'-(phenyl methylene)bis(5-phenylphenol) and the like.

Preferable condensates (two nuclei condensates) include 2,2'-methylenebis(4-methylphenol), 2,2'-methylenebis(4-ethylphenol), 2,2'-methylenebis(4-isopropylphenol), 2,2'-methylenebis(4-t-butylphenol), 2,2'-methylenebis(4-n-propylphenol), 2,2'-methylenebis(4-n-butylphenol), 2,2'-methylenebis(4-t-amylphenol), 2,2'-methylenebis(4-cumylphenol), 2,2'-ethylidenebis(4-methylphenol), 2,2'-ethylidenebis(4-ethylphenol), 2,2'-ethylidenebis(4-isopropylphenol), 2,2'-ethylidenebis(4-t-butylphenol), 2,2'-ethylidenebis(4-n-butylphenol), 2,2'-ethylidenebis(4-t-amylphenol), 2,2'-ethylidenebis(4-cumylphenol), 2,2'-butylidenebis(4-methylphenol), 2,2'-butylidenebis(4-t-butylphenol), and 2,2'-methylenebis(4-methylphenol), 2,2'-methylenebis(4-isopropylphenol), 2,2'-methylenebis(4-t-butylphenol), 2,2'-methylenebis(4-n-butylphenol), 2,2'-methylenebis(4-n-propylphenol), 2,2'-methylenebis(4-t-amylphenol), 2,2'-methylenebis(4-cumylphenol), 2,2'-ethylidenebis(4-t-butylphenol, and 2,2'-butylidenebis(4-t-butylphenol) among them are particularly preferable.

Additionally, specific examples of 3 to 5 nuclei condensates (i.e. condensates comprising ranging from 3 to 5 phenol skeletons of n=11, 2 or 3 in the above formula) may include compounds corresponding to specific examples listed for the above two nuclei condensates.

The condensate compositions represented by the general formula (chemical formula 1) are preferably two nuclei condensates or condensate compositions containing mainly two nuclei condensates and additionally at least one kind of 3 to 5 nuclei condensates, and are particularly preferably condensates containing mainly two nuclei condensate and additionally at least one kind of 3 to 5 nuclei condensates. The term "one kind of 3 to 5 nuclei condensates" include only condensate with 3 nuclei, or two kinds of condensates with 3 nuclei and 4 nuclei, and three kinds of condensates with 3 nuclei, 4 nuclei and 5 nuclei. The term "containing mainly two nuclei condensate" refers to that the content of condensates with 2 nuclei is maximum among various condensates constituting condensate composition. Furthermore, the condensate composition represented by general formula (chemical formula 1) may be used in the presence of condensates as an impurity with n=4 or more (condensates with 6 nuclei or more) in the general formula (chemical formula 1) as long as the purpose of the present invention is maintained.

Preferable condensate composition (condensate composition containing mainly condensates with 2 nuclei and additionally at least a kind of condensates with ranging from 3 to 5 nuclei) includes condensates containing mainly above exemplified 2 nuclei compounds and additionally corresponding 3 to 5 nuclei condensates.

In these condensate composition, the content of 2 nuclei condensate is preferably in the range between 40 and 99%, more preferably between 45 and 98%, and particularly preferably between 50 and 80%. "%" refers to "area %", which is obtained as a result of analysis by using a high performance liquid chromatography.

The condensate composition represented by the above chemical formula 1 and used in the present invention is prepared easily, for example, by well known synthetic method, wherein a substituted phenol is reacted with a ketone compound or an aldehyde compound in the presence of acid catalyst (e.g. hydrochloric acid, p-toluene sulfonic acid etc.). The reaction is conducted in the presence of an appropriate organic solvent (e.g. water, methanol, ethanol, n-propylalcohol, isopropylalkohol, acetonitril, toluene, chloroform, diethyl ether, N,N-dimethylacetamide, benzene, chlorobenzene, dichlorobenzene, diethylketone, ethylmethyl ketone, acetone, tetrahydrofuran etc.), which solubilizes raw materials and reaction products, and is inactive in the reaction, at the temperature between 0 and 150 degree C. for time period between several hours and several ten hours. The reaction yield will be improved by removing unreacted substituted phenols by distillation after the reaction.

Substituted phenols include phenol, p-chlorophenol, m-chlorophenol, o-chlorophenol, catechol, resorcinol, hydroquinone, p-cresol, m-cresol, o-cresol, p-ethylphenol, m-ethylphenol, o-ethylphenol, p-propylphenol, o-propylphenol, p-isopropylphenol, m-isopropylphenol, o-isopropylphenol, p-t-butylphenol, m-t-butylphenol, o-t-butylphenol, p-t-amylphenol, p-methoxyphenol, m-methoxyphenol, o-methoxyphenol, p-cyanophenol, m-cyanophenol, o-cyanophenol, p-nitrophenol, m-nitrophenol, o-nitrophenol, p-phenylphenol, m-phenylphenol, o-phenylphenol, p-cumylphenol, m-cumylphenol, o-cumylphenol, p-(α-methylbenzyl)phenol and the like. Specific examples of ketone and aldehyde compounds include dimethylketone, diethylketone, ethylmethylketone, methylisobutylketone, formaldehyde, benzaldehyde and the like, but not limited by them.

In the present invention, a stabilyzer may be used in order to improve oil resistance effect of recording images, and the stabilyzer includes 4,4'-butylidene (6-t-butyl-3-methylphenol), 2,2'-di-t-butyl-5,5'-dimethyl-4,4'-sulfonyldiphenol), 1,1,3-tris(2-methyl-4-hydroxy-5-cyclohexylphenyl) butane, 1,1,3-tris(2-methyl-4-hydroxy-5-t-butylphenyl) butane and the like unless it hampers the desired effect of the present invention. These stabilizers may be used solely or by mixing two kinds or more.

Preferred stabilizer in the present invention is a cross-linked diphenylsulfone compound represented by chemical formula 2:

[chemical formula 2]

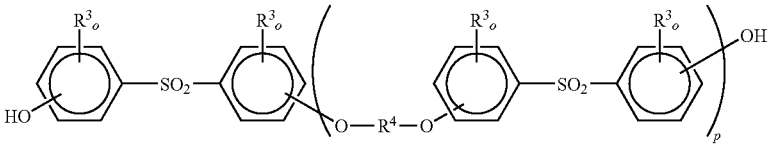

In the formula, $R^3$, may be identical to or different from the others, preferably identical, represents a hydrogen atom, a halogen atom, alkyl group with 1 to 6 carbon atoms or alkenyl group with 1 to 6 carbon atoms, preferably a hydrogen atom.

The alkyl group and the alkenyl group is an alkyl group with 1 to 6 carbon atoms and an alkenyl with 1 to 6 carbon atoms, respectively, and includes, for example, methyl, ethyl, n-propyl, isopropyl, n-butyl, sec-butyl, tert-butyl, n-pentyl, isopentyl, neopentyl, tert-pentyl, n-hexyl, isohexyl, 1-methylpentyl, 2-methylpentyl, vinyl, allyl, isopropenyl, 1-propenyl, 2-butenyl, 3-butenyl, 1,3-butadienyl, 2-methyl-2-propenyl group and the like.

Furthermore, a halogen atom represents chlorine, bromine, fluorine, or iodine, and preferably a chlorine atom and a bromine atom.

o, may be identical to or different from the others, represents an integer between 0 and 4, preferably 0.

OH and —$OR^4O$— group may be para-position to $SO_2$ group.

p is an integer between 1 and 11. The compound is preferably mixture of compounds with integer p between 1 and 11.

$R^4$, may be identical to or different from the others, preferably identical. $R^4$ may be (i) a hydrocarbon group, which is saturated or unsaturated, preferably saturated, and is linear or branched chain, preferably linear, with optially ether bonds and with 1 to 12 carbon atoms, preferably 3 to 7 carbon atoms. The hydrocarbon includes polyalkyleneoxide chain and alkylene group, preferably polyalkylene oxide chain. Polyalkyleneoxide chain (—$OR^4O$—) includes —O—$(C_nH_{2n}O)_{1\text{-}3}$— n=ranging from 2 to 4, preferably from 2 to 3, more preferably 2). The alkylene group includes —$C_mH_{2m}$—.

$R^4$ may be (ii) a substituted phenylene group represented by chemical formula 3:

[chemical formula 3]

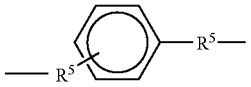

In the formula, $R^5$ represents methylene or ethylen group. $R^5$ is preferably located at para position each other.

Furthermore, $R^4$ may be (iii) a divalent group represented by chemical formula 4:

[chemical formula 4]

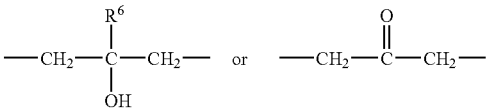

In the formula, $R^6$ represents a hydrogen atom or an alkyl group with 1 to 4 carbon atoms, preferably a hydrogen atom.

Among these, $R^4$ is preferably a hydrocarbon group with 1 to 12 carbon atoms, which may be saturated or unsaturated, linear or branched, and possibly has ether bond(s).

In the cross-linked diphenylsulfone compound of general formula (chemical formula 2), $R^4$ refers to, for example, methylene, ethylene, trimethylene, tetramethylene, pentamethylene, hexamethylene, heptamethylene, octamethylene, nanomethylene, decamethylene, undecamethylene, dodecamethylene, methylmethylene, dimethylmethylene, methylethylene, methyleneethylene, ethylethylene, 1,2-dimethylethylene, 1-methyltrimethylene, 1-methyltetramethylene, 1,3-dimethyltrimethylene, 1-ethyl-4-methyl-tetramethylene, vinylene, propenylene, 2-butenylene, ethynylene, 2-butynylene, 1-vinylethylene, ethyleneoxyethylene, tetramethyleneoxytetramethylene, ethyleneoxyethyleneoxyethylene, ethyleneoxymethyleneoxyethylene, 1,3-dioxane-5,5-bismethylene, 1,2-xylyl, 1,3-xylyl, 1,4-xylyl, 2-hydroxytrimethylene, 2-hydroxy-2-methyltrimethylene, 2-hydroxy-2-ethyltrimethylene, 2-hydroxy-2-propyltrimethylene, 2-hydroxy-2-isopropyltrimethylene, 2-hydroxy-2-butyltrimethylene and the like groups are included.

The cross-linked diphenylsulfone compound represented by the general formula (chemical formula 2) may include the mixture of substituent ($R^3$) and/or several kinds with different p number and the content is optional, there is no special limitation on the mixing method including mixture in powder, mixture of dispersion in water and the like, and simultaneous production and mixture of several kinds of cross-linked diphenylsulfone compounds depending on production condition.

The compounds represented by the general formula (chemical formula 2) include, for example, 4,4'-bis[4-[4-(4-hydroxyphenylsulfonyl)phenoxy]-2-trans-butenyloxy] diphenylsulfone; 4,4'-bis[4-(4-hydroxyphenylsulfonyl)phenoxy-4-butyloxy]diphenylsulfone; 4,4'-bis[4-(4-hydroxyphenylsulfonyl)phenoxy-3-propyloxy] diphenylsulfone; 4,4'-bis[4-(4-hydroxyphenylsulfonyl) phenoxy-2-ethyloxy]diphenylsulfone; 4-[4-(4-hydroxyphenylsulfonyl)phenoxy-4-butyloxy]-4'-[4-(4-hydroxyphenylsulfonyl)phenoxy-3-propyloxy] diphenylsulfone; 4-[4-(4-hydroxyphenylsulfonyl)phenoxy-4-butyloxy]-4'-[4-(4-hydroxyphenylsulfonyl)phenoxy-2-ethylaoxy]diphenylsulfone; 4-[4-(4-hydroxyphenylsulfonyl) phenoxy-3-propyloxy]-4'-[4-(4-hydroxyphenylsulfonyl) phenoxy-2-ethyloxy]diphenylsulfone; 4,4'-bis[4-(4-hydroxyphenylsulfonyl)phenoxy-5-pentyloxy] diphenylsulfone; 4,4'-bis[4-(4-hydroxyphenylsulfonyl) phenoxy-6-hexyloxy]diphenylsulfone; 4-[4-[4-(4-hydroxyphenylsulfonyl)phenoxy]-2-trans-butenyloxy]-4'-[4-(4-hydroxyphenylsulfonyl)phenoxy-4-butyloxy]-diphenylsulfone; 4-[4-(4-hydroxyphenylsulfonyl)phenoxy-2-trans-butenyloxy]-4'-[4-(4-hydroxyphenylsulfonyl) phenoxy-3-propyloxy]diphenylsulfone; 4-[4-[4-(4-hydroxyphenylsulfonyl)phenoxy-2-trans-butenyloxy]-4'-[4-(4-hydroxyphenylsulfonyl)phenoxy-2-ethyloxy] diphenylsulfone; 1,4-bis[4-[4-[4(4-hydroxyphenylsulfonyl) phenoxy-2-trans-butenyloxy]phenylsulfonyl]phenoxy]cis-2-butene; 1,4-bis[4-[4-[4-(4-hydroxyphenylsulfonyl) phenoxy-2-trans-butenyloxy]phenylsulfonyl]phenoxy]-trans-2-butene; 4,4'-bis[4-[4-(2-hydroxyphenylsulfonyl) phenoxy]butyloxy]diphenylsulfone; 4,4'-bis[4-[2-(4-hydroxyphenylsulfonyl)phenoxy]butyloxy]diphenylsulfone; 4,4'-bis[4-(4-hydroxyphenylsulfonyl)phenoxy-2-ethyl-eneoxyethoxy]diphenylsulfone; 4,4'-bis[4-(4-hydroxyphenylsulfonyl)phenyl-1,4-phenylenebis-methyleneoxy]diphenylsulfone; 4,4'-bis[4-(4-hydroxyphenylsulfonyl)phenyl-1,3-phenylenebismethyleneoxy]diphenylsulfone; 4,4'-bis[4-(4-hydroxy-phenylsulfonyl)phenyl-1,2-phenylenebis-methyleneoxy]diphenylsulfone; 2,2'-bis[4-[4-[4-(4-hydroxyphenylsulfonyl)phenoxy-2-ethyleneoxyethoxy] phenylsulfonyl]phenoxy]diethylether; α,α'-bis[4-[4-[4-(4-hydroxy-phenylsulfonyl)phenyl-1,4-phenylenebismethyleneoxy]phenylsulfonyl]phenoxy]-p-xylene; α,α'-bis[4-[4-[4-(4-hydroxyphenylsulfonyl)phenyl-1,3-phenylenebismethyleneoxy]phenylsulfonyl]phenoxy]-m-xylene; α,α'-bis[4-[4-[4-(4-hydroxyphenylsulfonyl) phenyl-1,2-phenylenebismethyleneoxy]phenylsulfonyl] phenoxy]-o-xylene; 2,4'-bis[2-(4-hydroxyphenylsulfonyl) phenoxy-2-ethyleneoxyethoxy]diphenylsulfone; 2,4'-bis[4-(2-hydroxyphenylsulfonyl)phenoxy-2-ethyleneoxyethoxy] diphenylsulfone; 4,4'-bis[3,5-dimethyl-4-(3,5-dimethyl-4-hydroxyphenylsulfonyl)phenoxy-2-ethyleneoxyethoxy] diphenylsulfone; 4,4'-bis[3-allyl-4-(3-allyl-4-hydroxyphenylsulfonyl)phenoxy-2-ethyleneoxyethoxy] diphenylsulfone; 4,4'-bis[3,5-dimethyl-4-(3,5-dimethyl-4-hydroxyphenylsulfonyl)phenyl-1,4-phenylenebismethyleneoxy]diphenylsulfone; 4,4'-bis[3,5-dimethyl-4-(3,5-dimethyl-4-hydroxyphenylsulfonyl) phenyl-1,3-phenylenebis-methyleneoxy]diphenylsulfone; 4,4'-bis[3,5-dimethyl-4-(3,5-dimethyl-4-hydroxyphenylsulfonyl)phenyl-1,2-phenylenebismethyleneoxy]diphenylsulfone; 4,4'-bis[3-allyl-4-(3-allyl-4-hydroxyphenylsulfonyl) 1,4-phenylenebismethyleneoxy]diphenylsulfone; 4,4'-bis[3-allyl-4-(3-allyl-4-hydroxyphenylsulfonyl) 1,3-phenylenebismethyleneoxy]diphenylsulfone; 4,4'-bis[3-allyl-4-(3-allyl-4-hydroxyphenylsulfonyl) 1,2-phenylenebismethyleneoxy]diphenylsulfone; 4,4'-bis[4-(4-hydroxyphenylsulfonyl)phenoxy-2-hydroxypropyloxy] diphenylsulfone; 1,3-bis[4-[4-[4-(4-hydroxyphenylsulfonyl) phenoxy-2-hydroxypropyloxy]phenylsulfonyl]phenoxy-2-hydroxypropane and the like.

When several kinds of cross-linked diphenylsulfone compounds represented by the general formula (chemical formula 2) are mixed and used, particularly preferred compound comprises more than two of the compounds with identical $R^3$ but different p. The production method of these compounds is simple and the compounds with different p can be produced at the same time by changing the reaction rate of ingredients with desired content ratio. Among them, compounds with p=1 include, for example, 1,3-bis[4-(4-hydroxyphenylsulfonyl)phenoxy]-2-hydroxypropane; 1,1-bis[4-(4-hydroxyphenylsulfonyl)phenoxy]methane 1,2-bis[4-(4-hydroxyphenylsulfonyl)phenoxy]ethane; 1,3-bis[4-(4-hydroxyphenylsulfonyl)phenoxy]-propane; 1,4-bis[4-(4-hydroxyphenylsulfonyl)phenoxy]butane; 1,5-bis[4-(4-hydroxyphenylsulfonyl)phenoxy]pentane; 1,6-bis[4-(4-hydroxyphenylsulfonyle) phenoxy]hexane; α,α'-bis[4-(4-hydroxyphenylsulfonyl)phenoxy]-p-xylene; α,α'-bis[4-(4-hydroxyphenylsulfonyl)phenoxy]-m-xylene; α,α'-bis[4-(4-hydroxyphenylsulfonyl)phenoxy]-o-xylene; 2,2'-bis[4-(4-hydroxyphenylsulfonyl)phenoxy]diethylether; 4,4'-bis[4-(4-hydroxyphenylsulfonyl)phenoxy]dibutylether; 1,2-bis[4-(4-hydroxyphenylsulfonyl)phenoxy]ethylene; 1,4-bis[4-(4-hydroxyphenylsulfonyl)phenoxy]-2-butene and the like (please refer, for example, Japanese Patent Application Public Disclosure No. 7-149713, International Publication WO093/06074, WO95/33714).

The cross-linked diphenylsulfone compounds are preferably used at the proportion in the range between 0.01 and 10.0 weight parts, preferably between 0.1 and 5.0 weight parts, based on one part of the condensate composition represented by chemical formula 1. If the content of cross-linked diphenylsulfone compound is 0.01 weight part or less per 1 part of the condensate compound or the condensates, it is difficult to obtain enough recording sensitivity, thermal resistance, water resistance, heat and humidity resistance and the like. On the contrary, if the content is 10.0 weight parts or more, the recording sensitivity and the quality of thermosensitive recording medium (thermosensitive recording layer) tends to be lowered.

As the sensitizer in the present invention, conventionally well known sensitizers can be used. Such sensitizer includes aliphatic amides such as amide stearate, amide palmitate and the like, ethylenebis amide, wax montanoate, waxpolyethylene, 1,2-di-(3-methylphenoxy)ethane, p-benzylbiphenyl, β-benzyloxynaphthalene, 4-biphenyl-p-triether, m-terphenyl, 1,2-diphenoxyethane, dibenzyl oxalate, di(p-chlorobenzyl)oxalate, di(p-methylbenzyl)oxalate, dibenzyltere phthalate, benzyl-p-benzyloxy benzoate, di-p-tolylcarbonate, phenyl-α-naphthyl carbonate, 1,4-diethoxy naphthalene, 1-hydroxy-2-naphthoicphenylester, o-xylene-bis-(phenylether), 4-(m-methylphenoxymethyl)biphenyl, 4,4'-ethylenedioxy-bis-benzoicdibenzylester, dibenzoyloxymethane, 1,2-di(3-methylphenoxy)ethylene, bis[2-(4-methoxy-phenoxy)ethyl]ether, p-nitromethyl benzoate, p-toluenephenyl sulfonate, but are not limited by them particularly. These sensitizers could be used solely or in combination of two kinds or more.

The binder used in the thermosensitive recording medium of the present invention include completely saponified polyvinyl alcohol with polymelization degree in the range between 200 and 1900, partially saponified polyvinyl alcohol, acetoacetylated polyvinyl alcohol, carboxy modified polyvinyl alcohol, amide modified polyvinyl alcohol, sulfonic acid modified polyvinyl alcohol, butyral modified polyvinyl alcohol, olefin modified polyvinyl alcohol, nitryl modified polyvinyl alcohol, pyrrolidone modified polyvinyl alcohol, silicone modified polyvinyl alcohol, other modified polyvinyl alcohol, hydroxyethyl cellulose, methylcellulose, ethylcellulose, carboxymethylcellulose, stylene-maleic anhydride copolymer, stylene-butadiene copolymer and ethylcellulose, cellulose derivatives such as acethylcellulose, casein, Arabic gum, oxidized starch, etherified starch, dialdehyde starch, esterified starch, polyvinylchloride, polyvinylacetate, polyacrylamide, polyacrylate ester, polyvinylbutyrate, polystyrol and their copolyner, polyamide resin, silicone resin, petroleum resin, terpen resin, ketone resin, coumarone resin, and the like. These polymers are used by dissolving in such solvents as water, alcohol, ketones, esters, hydrocarbons, by emulsifying or dispersing to paste in water or in other solvent, or in combination of them depending on the required quality.

The cross-linking agents used in the present invention includes glyoxal, methylol melamine, melamine formaldehyde resin, melamine urea resin, polyamine epichlorohydrin resin, polyamido epichlorohydrin resin, potassiun persulfate, ammonium presulfate, sodium persulfate, ferric chloride, magnesium chloride, borax, boric acid, alum, ammonium chloride and the like.

The pigment used in the present invention includes fillers such as inorganic or organic silica, calcium carbonate, kaoline, calcined kaoline, silious earth, talc, titanium oxide, aluminium hydroxide and the like.

The lubricants used in the present invention include aliphatic metal salts such as zinc stearate, calcium stearate; waxes, silicon resins.

Moreover, UV absorber such as benzophenone and triazole, dispersing agents, antifoam agents, antioxidants, fluorescent dyes and the like can be used.

Binders, cross-linking agents, pigment and the like can be used for all of the coating layers arranged necessarily such as a protecting layer, a thermosensitive recording layer, an undercoating layer and the like as well as the layer containing powdered cellulose unless it hampers the desired effect of the present invention.

The sort and content of the various component such as dye, developing agent and the like used for the thermosensitive recording layer of the present invention is determined according to the required performance and suitability for recording. Without any limitation, the thermosensitive recording layer usually comprises a developing agent in the range between 0.5 and 10 weight parts, a pigment (including powdered cellulose) in the range between 0.5 and 20 weight parts, a sensitizer in the range between about 0.5 and 10 weight parts, stabilizer in the range between about 0.01 and 10 weight parts and other component in the range between about 0.01 and 10 weight parts based on one part of basic colorless dye.

Dye, developing agents and materials added when necessary are prepared as coating liquid by grinding to particles with particle diameter of several μm or less by a grinder mill such as ball mills, attritors, sand grinders or a suitable emulsification apparatus and by adding with binder and several kinds of additives depending on the object. Water or alcohol is used for the solvent of the coating liquid and the solid part is in the range between about 20 and 40 weight %.

Thermosensitive recording medium of the present invention can be obtained by coating the coating liquids comprising the above composition to any substrate such as paper, recycled paper, synthetic paper, film, plastic film, plastic foam film, non-woven cloth and the like. Or their composite material can be used as a substrate.

Dye, developing agents and materials added if necessary are prepared as coating liquid by grinding to particles with particle diameter of several μm or less by a grinder mill such as ball mills, attritosr, sand grinders and the like or a suitable emulsification apparatus and by adding with binder and several kinds of additives depending on the object. Water or alcohol is used for the solvent of the coating liquid and the solid part is in the range between about 20 and 40 weight %. The mean for coating is not particularly limited and is according to conventional well known coating technology. For example, off-machine coating or on-machine coating apparatus equipped with airknife coater, rodbread coater, bentblade cater, bevelblade coater, roll coater, curtain coater and the like can be suitably chosen and used. The amount of coating in thermosensitive coating layer is not particularly limited, and generally solid dry weight is in the range between 2 and 12 g/m$^2$. Furthermore, the amount of coating on protecting layer laminated on thermosensitive recording layer is not particularly limited and is in the range between 1 and g/m$^2$.

Moreover, the thermosensitive recording medium may be coated with undercoating layer comprising loading material and binder between a substrate and a thermosensitive recording medium in order to improve recording sensitivity. Also it is possible to form a back coat layer to the opposite side of the thermosensitive recording layer on the substrate to improve the curl. Additionally, various well-known technology in the field of thermosensitive recording medium applying data smoothing such as super calendering after all coating processes is suitably added if necessary.

EXAMPLES

The present invention is illustrated by the following Examples, but it is not intended to limited the scope of the present invention by them. "Part" and "%" refer to "weight part" and "weight %", respectively. Mean particle diameter is measured by laser diffraction-scattering method (Malvern Co., Using Mastersizer S). Oil absorption and apparent specific volume are measured according to Japanese Industrial Standard (JIS) K-5101, water absorption at saturation is measured according to JIS L-1907, and brightness is measured according to JIS P8148.

Production Example 1

In this Production Example, powdered cellulose was prepared by dry grinding method.

Wooden pulp (soft-wood kraft pulp) 10 g was mixed with 500 ml of 1 N sulfuric acid, and heated at 100 degree C. in water bath for 60 min. to hydrolyzates. The pulp slurry was filtrated through 300 mesh filter fabric and the residues were washed with 500 ml of 0.1 N ammonium water and then with enough amount of tap water. The hydrolyzed cellulose was dried under blowing drier at 120 degree C. for 12 hours. The dried cellulose was ground by dry mill (Aishin Nano Technologies, Nano Jetmizer NJ-300) at ambient temperature and the following various powdered cellulose were prepared by changing the grinding period.

Powdered cellulose 1: mean particle diameter: 5.5 μm, oil absorption: 170 ml/100 g, apparent specific volume: 0.50 g/cm$^3$, brightness: 84%, water absorption at saturation: 1.9 cm$^3$/g Powdered cellulose 2: mean particle diameter: 11 μm, oil absorption: 190 ml/100 g, apparent specific volume: 0.50 g/cm$^3$, brightness: 85%, water absorption at saturation: 2.2 cm$^3$/g Powdered cellulose 3: mean particle diameter: 20 μm, oil absorption: 220 ml/100 g, apparent specific volume: 0.50 g/cm$^3$, brightness: 84%, water absorption at saturation: 2.5 cm$^3$/g Production Example 2

In this Production Example, powdered cellulose was prepared by wet grinding method.

Powdered cellulose (Nippon Paper Chemicals Co., Ltd., KC FLOCK-W100, mean particle diameter: 50 μm) was dispersed in water to prepare 10% slurry. The slurry 200 cc was ground at ambient temperature for 2 hr by using a sand grinder (Ashizawa Finetec Co., Ltd., Sand grinder) with 500 ml volume filled with 0.5 μm glass beads at the filling rate of 50%. Then the ground slurry was dried with a blowing drier at 120 degree C. for 12 hours to produce fine cellulose (mean particle diameter: 6 μm, oil absorption: 90 ml/100 g, apparent specific volume: 0.20 g/cm$^3$, brightness: 80%, water absorption at saturation: 1.3 cm$^3$/g.

The compositions of the following formulation were stirred and dispersed to prepare various solution, dispersion liquid or coating liquid.

[Preparation of Undercoating Layer Coating Composition]

Undercoating Layer Coating Liquid

| | |
|---|---|
| Calcined Kaolin (Engelhard Co., Ansilex 90) | 90.0 parts |
| Styrene-butadiene copolymer Latex (Solid content 50%) | 10.0 parts |
| Water | 50.0 parts |

The mixture of the above formulation was stirred and mixed to prepare the undercoating layer coating liquid.

[Preparation of Thermosensitive Recording Layer Coating Compositions]

Developing agent dispersion liquids, basic colorless dye dispersion liquids, sensitizer dispersion liquids and stabilizer dispersion liquids with the following formulations were wet ground separately to average particle diameter with 1 μm by using a sand grinder.

Liquid A (Developing Agent Dispersion Liquid 1)

| | |
|---|---|
| The condensate composition containing 2,2'-methylenebis (4-t-butylphenol) (API corporation, JKY224, Composition: 2,2'-methylenebis (4-t-butylphenol): 62.3 weight %; 3 nuclei condensate: 25.3 weight %; 4 nuclei condensate: 9.3 weight %; 5 or more nuclei condensates: remaining parts) | 6.0 parts |
| Polyvinyl alcohol 10% aqueous solution | 18.8 parts |
| Water | 11.2 parts |

Liquid B (Developing Agent Dispersion Liquid 2)

| | |
|---|---|
| 2,4-bisphenolsulfone | 6.0 parts |
| Polyvinyl alcohol 10% aqueous solution | 18.8 parts |
| Water | 11.2 parts |

Liquid C (Basic Colorless Dye Dispersion Liquid)

| | |
|---|---|
| 3-dibutylamino-6-methyl-7-anilinofluoran (ODB-2) | 2.0 parts |
| Polyvinyl alcohol 10% aqueous solution | 4.6 parts |
| Water | 2.6 parts |

Liquid D (Sensitizer Dispersion Liquid)

| | |
|---|---|
| 1,2bisphenoxybenzene | 6.0 parts |
| Polyvinyl alcohol 10% solution | 20.0 parts |
| Water | 11.0 parts |

Liquid E (Stabilizer Dispersion Liquid 1)

| | |
|---|---|
| 2,2'-bis [4-(4-hydroxyphenylsulfone) phenoxy]diphenylether (Nippon Soda Co. LTD., D-90*) | 6.0 parts |
| Polyvinyl alcohol 10% aqueous solution | 18.8 parts |
| Water | 11.2 parts |

*The formula of D-90 is represented by chemical formula 5:

[chemical formula 5]

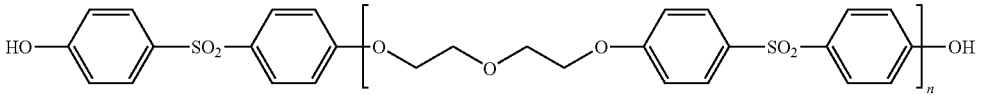

(mixture of n = 1 to 11)

Liquid F (Stabilizer Dispersion Liquid 2)

| | |
|---|---|
| 4-benxyloxy-4'-(2,3epoxy-2-methylpropyloxybisphenolsulfone) (Nippon Soda Co. LTD., NTZ95*) | 6.0 parts |
| Polyvinyl alcohol 10% aqueous solution | 18.8 parts |
| Water | 11.2 parts |

*The formula of NTZ95 is represented by chemical formula 6:

[chemical formula 6]

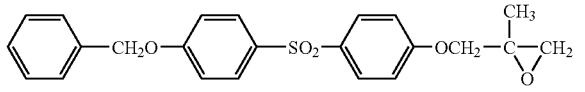

Then, thermosensitive recording layer coating liquids were prepared by mixing dispersion liquids with the following formulation.

<Thermosensitive Recording Layer Coating Liquid 1>

| | |
|---|---|
| Liquid A (22% Developing agent dispersion liquid 1) | 25 parts |
| Liquid C (30% Basic colorless dye dispersion liquid) | 14 parts |

-continued

| | |
|---|---|
| Liquid D (16% Sensitizer dispersion liquid) | 20 parts |
| Liquid E (16% Stabilizer dispersion liquid 1) | 20 parts |
| silica (Mizusawa Industrual Chemicals Co. LTD., MyzucasilP604) 25% dispersion liquid | 2 parts |
| Polyvinyl alcohol 10% aqueous solution | 19 parts |

<Thermosensitive Recording Layer Coating Liquid 2>

| | |
|---|---|
| Liquid B (22% Developing agent dispersion liquid 1) | 25 parts |
| Liquid C (30% Basic colorless dye dispersion liquid) | 14 parts |
| Liquid D (16% Sensitizer dispersion liquid) | 20 parts |
| Liquid E (16% Stabilizer dispersion liquid 1) | 20 parts |
| Silica (Mizusawa Industrual Chemicals Co. LTD., MyzucasilP604) 25% dispersion liquid | 2 parts |
| Polyvinyl alcohol 10% aqueous solution | 19 parts |

<Thermosensitive Recording Layer Coating Liquid 3>

| | |
|---|---|
| Liquid A (22% Developing agent dispersion liquid 1) | 25 parts |
| Liquid C (30% Basic colorless dye dispersion liquid) | 14 parts |
| Liquid D (16% Sensitizer dispersion liquid) | 20 parts |
| Silica (Mizusawa Industrual Chemicals Co. LTD., MyzucasilP604) 25% dispersion liquid | 2 parts |
| Polyvinyl alcohol 10% aqueous solution | 19 parts |

<Thermosensitive Recording Layer Coating Liquid 4>

| | |
|---|---|
| Liquid A (22% Developing agent dispersion liquid 1) | 25 parts |
| Liquid C (30% Basic colorless dye dispersion liquid) | 14 parts |
| Liquid D (16% Sensitizer dispersion liquid) | 20 parts |
| Liquid F (16% Stabilizer dispersion liquid 2) | 20 parts |
| Silica (Mizusawa Industrual Chemicals Co. LTD., MyzucasilP604) 25% dispersion liquid | 2 parts |
| Polyvinyl alcohol 10% aqueous solution | 19 parts |

<Thermosensitive Recording Layer Coating Liquid 5>

| | |
|---|---|
| Liquid A (22% Developing agent dispersion liquid 1) | 25 parts |
| Liquid C (30% Basic colorless dye dispersion liquid) | 14 parts |
| Liquid D (16% Sensitizer dispersion liquid) | 20 parts |
| Powdered cellulose 1 prepared in Production Example 1, 15% dispersion liquid | 10 parts |
| Polyvinyl alcohol 10% aqueous solution | 19 parts |

<Thermosensitive Recording Layer Coating Liquid 6>

| | |
|---|---|
| Liquid A (22% Developing agent dispersion liquid 1) | 25 parts |
| Liquid C (30% Basic colorless dye dispersion liquid) | 14 parts |
| Liquid D (16% Sensitizer dispersion liquid) | 20 parts |
| Silica (Mizusawa Industrual Chemicals Co. LTD., MyzucasilP604) 25% dispersion liquid | 10 parts |
| Polyvinyl alcohol 10% aqueous solution | 19 parts |

[Preparation of Protecting Layer Coating Compositions]

Protecting layer coating liquids 1 to 6 were prepared by mixing compositions with the following formulation.

<Protecting Layer Coating Liquid 1.>

| | |
|---|---|
| Carboxy modified polyvinyl alcohol 10% solution (Kuraray Co. LTD., PVA-KL318, Polymerization degree: 1800, Saponification level: 99 mol %) | 100 parts |
| Polyamide epichlorohydrin resin (SeikoPMC Co. LTD., WS4020, Solid content: 25%, Cationization degree: 2.7, Molecular weight: 2200,000, Quaternary amine) | 10 parts |
| Modified polyamide resin (Sumitomo Chemicals, Sumirez resin SPI-106N, Solid content 45%) | 3 parts |
| Powdered cellulose 1 prepared in Production Example 1 15% dispersion liquid | 200 parts |
| Zinc stearate (Chukyo Yushi Co. LTD., HydrinE-366, Solid content: 40%) | 5 parts |

<Protecting Layer Coating Liquid 2>

| | |
|---|---|
| Carboxy modified polyvinyl alcohol (PVA-KL318) 10% solution | 100 parts |
| Polyamide epichlorohydrin resin (WS4020) | 10 parts |
| Modified polyamide resin (Smirez resin SP1-106N) | 3 parts |
| Powdered cellulose 2 prepared in Production Example 1 15% dispersion liquid | 200 parts |
| Zinc stearate (HydrinE-366) | 5 parts |

<Protecting Layer Coating Liquid 3>

| | |
|---|---|
| Carboxy modified polyvinyl alcohol (PVA-KL318) 10% solution | 100 parts |
| Polyamide epichlorohydrin resin (WS4020) | 10 parts |
| Modified polyamide resin (Smirez resin SP1-106N) | 3 parts |
| Powdered cellulose 3 prepared in Production Example 1 15% dispersion liquid | 200 parts |
| Zinc stearate (HydrinE-366) | 5 parts |

<Protecting Layer Coating Liquid 4>

| | |
|---|---|
| Carboxy modified polyvinyl alcohol (PVA-KL318) 10% solution | 100 parts |
| Polyamide epichlorohydrin resin (WS4020) | 10 parts |
| Modified polyamide resin (Smirez resin SP1-106N) | 3 parts |
| Cellulose (Asahi Kasei Co., Ceolus cream FP-03, mean particle diameter: 3 μm) 10% dispersion liquid | 300 parts |
| Zinc stearate (HydrinE-366) | 5 parts |

<Protecting Layer Coating Liquid 5>

| | |
|---|---|
| Carboxy modified polyvinyl alcohol (PVA-KL318) 10% solution | 100 parts |
| Polyamide epichlorohydrin resin (WS4020) | 10 parts |
| Modified polyamide resin (Smirez resin SP1-106N) | 3 parts |
| Powdered cellulose (Nippon Paper Chemicals Co. LTD., KCFlockW100, Mean particle diameter: 50 μm, oil absorption: 200 ml/100 g, apparent specific volume: 0.25 g/cm$^3$, brightness: 84%, water absorption at saturation: 2.8 cm$^3$/g) 15% dispersion liquid | 200 parts |
| Zinc stearate (HydrinE-366) | 5 parts |

<Protecting Layer Coating Liquid 6>

| | |
|---|---|
| Carboxy modified polyvinyl alcohol (PVA-KL318) 10% solution | 100 parts |

-continued

| | |
|---|---|
| Polyamide epichlorohydrin resin (WS4020) | 10 parts |
| Modified polyamide resin (Smirez resin SP1-106N) | 3 parts |
| Fine cellulose prepared in Production Example 2 | 300 parts |
| Zinc stearate (HydrinE-366) | 5 parts |

<Protecting Layer Coating Liquid 7>

| | |
|---|---|
| Carboxy modified polyvinyl alcohol (PVA-KL318) 10% solution | 100 parts |
| Polyamide epichlorohydrin resin (WS4020) | 10 parts |
| Modified polyamide resin (Smirez resin SP1-106N) | 3 parts |
| Silica (Mizusawa Industrual Chemicals Co. LTD., MyzucasilP603, Mean particle diameter: 4 μm) 25% dispersion liquid | 120 parts |
| Zinc stearate (HydrinE-366) | 5 parts |

[Preparation of Back Layer Coating Liquid]

| | |
|---|---|
| Aluminium hydroxide | 50 parts |
| Polyvinyl alcohol (Kuraray Co. LTD., PVA117) 10% aqueous solution | 500 parts |
| Water | 70 parts |

Example 1

The undercoating layer coating liquid was coated on a free paper (basic weight: 47 g/m$^2$) by using Mayer bar to make the coating amount (dried) of 7 g/m$^2$, and dried by using a blowing drier (120 degree C., 1 min). Then the recording coating liquid 1 was coated on the paper by using Mayer bar to make the coating amount (dried) of 4.5 g/m$^2$, and dried by using a blowing drier (60 degree C., 2 min). The protecting coating liquid 1 was coated on the coated paper by using Mayer bar to make the coating amount (dried) of 2.5 g/m$^2$. Furthermore, the back layer coating liquid was coated on the back of the previous coated paper by using Mayer bar to make the coating amount (dried) of 1.5 g/m$^2$, dried by using a blowing drier (60 degree C., 2 min), and then treated with super calendar to produce a thermosensitive recording medium with surface smoothness between 200 and 500 sec.

Example 2

A thermosensitive recording medium was prepared similarly to Example 1 except using the protecting layer coating liquid 2 instead of the protecting layer coating liquid 1.

Example 3

A thermosensitive recording medium was prepared similarly to Example 1 except using the protecting layer coating liquid 3 instead of the protecting layer coating liquid 1.

Example 4

A thermosensitive recording medium was prepared similarly to Example 1 except using the thermosensitive recording layer coating liquid 2 instead of the thermosensitive recording layer coating liquid 1.

Example 5

A thermosensitive recording medium was prepared similarly to Example 1 except using the thermosensitive recording layer coating liquid 3 instead of the thermosensitive recording layer coating liquid 1.

Example 6

A thermosensitive recording medium was prepared similarly to Example 1 except using the thermosensitive recording layer coating liquid 4 instead of the thermosensitive recording layer coating liquid 1.

Example 7

The undercoating layer coating liquid was coated on a free paper (basic weight: 47 g/m$^2$) by using Mayer bar to make the coating amount (dried) of 7 g/m$^2$, and dried by using a blowing drier (120 degree C., 1 min). The recording coating liquid 5 was coated on the under paper by using Mayer bar to make the coating amount (dried) of 4.5 g/m$^2$, and dried by using a blowing drier (60 degree C., 2 min). The back layer coating liquid was coated on the back of the previous coated paper by using Mayer bar to make the coating amount (dried) of 1.5 g/m$^2$, dried by using a blowing drier (60 degree C., 2 min), and then treated with super calendar to produce a thermosensitive recording medium with surface smoothness between 200 and 500 sec.

Comparative Example 1

A thermosensitive recording medium was prepared similarly to Example 1 except using the protecting layer coating liquid 4 instead of the protecting layer coating liquid 1.

Comparative Example 2

A thermosensitive recording medium was prepared similarly to Example 1 except using the protecting layer coating liquid 5 instead of the protecting layer coating liquid 1.

Comparative Example 3

A thermosensitive recording medium was prepared similarly to Example 1 except using the protecting layer coating liquid 6 instead of the protecting layer coating liquid 1.

Comparative Example 4

A thermosensitive recording medium was prepared similarly to Example 1 except using the protecting layer coating liquid 7 instead of the protecting layer coating liquid 1.

Comparative Example 5

A thermosensitive recording medium was prepared similarly to Example 7 except using the thermosensitive recording layer coating liquid 6 instead of the thermosensitive recording layer coating liquid 5.

The following properties were evaluated on the thermosensitive recording medium prepared in the above Examples and Comparative Examples.

<Recording Sensitivity>

The prepared thermosensitive recording medium were printed by a printing tester for thermosensitive recording paper (Ohkura Engineering Co. LTD., TH-PMD equipped with a thermal head by Kyosera Co.) at recording energy of 0.27 mJ/dot. The Density of the printed image was measured and evaluated by using Macbeth Densitometer (RD-914).

<Image Quality>

All over printing area was evaluated by naked eyes.

Good: Printed with clear black as a whole.

Poor: Blurred whitely as a whole

<Anti-Scratching Ability>

Line color formation after scratching by steel wool on the coated surface at the weight of 1000 g/cm$^2$.

Excellent: Almost no color formation

Good: Faint color formation

Poor: Dense color formation

<Stamping Ability>

Stamp was printed on the prepared thermosensitive recording medium blank sheet, wiped off by a tissue paper at 5 sec after stamping and evaluated by naked eyes.

Good: The stamped letter remains on the sheet with slight grazing and can be read Poor: The stamped letter is grazed and can not be read <Storage Stability>

Checkered pattern No. 8 was printed by using the thermal printing tester (Ohkura Engineering Co. LTD., TH-PMD), and color part was evaluated on the following storage stability.

(Persistency of Plasticizer Resistance)

A paper tube was wrapped with a vinyl chloride wrap (Mitsui Chemicals, Inc., High wrap KMA), then wrapped with the above sample, and wrapped with the vinyl chloride wrap three times. Then this paper tube was stored for 4 hr at 23 degree C. Color density was measured before and after the above test and the persistency (=color density after the test/color density before the test×100 (%)) was calculated. The higher the persistency, the better the resistance for plasticizer.

(Persistency of Water Resistance)

The sample was immersed in tap water for 24 hr and left for air drying. The color density before and after the test was measured and persistency (=color density after the test/color density before the test×100 (%)) was calculated. The higher the persistency, the better the resistance for water.

Evaluation results were listed in the following tables.

What is claimed is:

1. A thermosensitive recording medium having a thermosensitive recording layer comprising at least a colorless or pale colored basic leuco dye and an electron accepting developing agent as one of one or more layers on a substrate, wherein at least an outermost layer of the one or more layers contains powdered cellulose, wherein the powdered cellulose is prepared by dry grinding wooden or non-wooden pulp at ambient temperature and has a mean particle diameter ranging from 5 to 30 μm.

2. The thermosensitive recording medium of claim 1, wherein the thermosensitive recording layer contains:

(a) a condensate composition, as the electron accepting developing agent, comprising condensates represented by chemical formula 1:

[chemical formula 1]

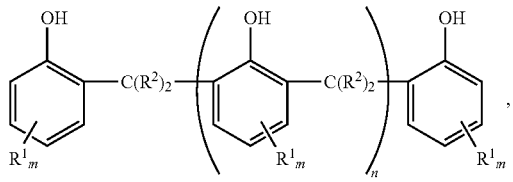

wherein each $R^1$, which may be identical to or different from the others, represents a hydrogen atom, a halogen atom, hydroxyl, lower alkyl, alkoxyl, cyano, nitro, aryl or aralkyl group, and each $R^2$, which may be identical to or different from the others, represents a hydrogen atom, alkyl, or aryl group, m represents an integer between 0 and 3, and n represents an integer between 0 and 3, and (b) a cross-linked diphenylsulfone compound, as a stabilizer, which is represented by chemical formula 2:

TABLE 1

| | | Examples | | | | | | |
|---|---|---|---|---|---|---|---|---|
| | | 1 | 2 | 3 | 4 | 5 | 6 | 7 |
| Recording sensitivity | | 1.47 | 1.40 | 1.31 | 1.25 | 1.46 | 1.20 | 1.51 |
| Image quality | | Good | Good | Good | Good | Good | Good | Good |
| Anti-scratching ability | | Excellent | Excellent | Excellent | Excellent | Excellent | Excellent | Good |
| Stamping ability | | Good | Good | Good | Good | Good | Good | Good |
| Storage stability | Persistency of plasticizer resistance (%) | 90 | 90 | 90 | 80 | 20 | 70 | 60 |
| | Persistency of water resistance (%) | 90 | 90 | 90 | 30 | 60 | 40 | 80 |

TABLE 2

| | | Comparative Examples | | | | |
|---|---|---|---|---|---|---|
| | | 1 | 2 | 3 | 4 | 5 |
| Recording sensitivity | | 1.39 | 1.21 | 1.45 | 1.16 | 1.44 |
| Image quality | | Good | Poor | Good | Poor | Good |
| Anti-scratching ability | | Good | Good | Good | Poor | Poor |
| Stamping ability | | Poor | Good | Poor | Good | Good |
| Storage stability | Persistency of plasticizer resistance (%) | 90 | 80 | 90 | 80 | 90 |
| | Persistency of water resistance (%) | 90 | 70 | 90 | 90 | 90 |

[chemical formula 2]

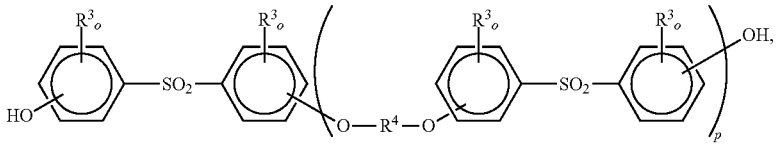

wherein each $R^3$, which may be identical to or different from the others, represents a hydrogen atom, a halogen atom, alkyl group with 1 to 6 carbon atoms or alkenyl group with 1 to 6 carbon atoms, each o, which may be identical to or different from the others, represents an integer between 0 and 4, p is an integer between 1 and 11, and each $R^4$, which may be identical to or different from the others, represents (i) a linear or branched, saturated or unsaturated, hydrocarbon group with 1 to 12 carbon atoms with optional ether bonds, (ii) a substituted phenylene group represented by chemical formula 3:

[chemical formula 3]

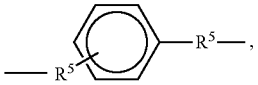

wherein $R^5$ represents a methylene or ethylene group, or (iii) a divalent group represented by chemical formula 4:

[chemical formula 4]

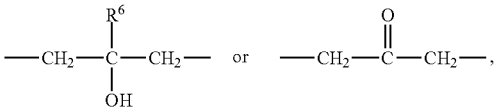

wherein $R^6$ represents a hydrogen atom or an alkyl group with 1 to 4 carbon atoms.

3. The thermosensitive recording medium of claim 1 or 2, wherein the thermosensitive recording medium has a protecting layer on the thermosensitive recording layer and the protecting layer is the outermost layer.

* * * * *